US008002969B2

(12) United States Patent
Hamad

(10) Patent No.: US 8,002,969 B2
(45) Date of Patent: Aug. 23, 2011

(54) UPGRADING CRUDE OIL USING ELECTROCHEMICALLY-GENERATED HYDROGEN

(75) Inventor: Esam Zaki Hamad, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 363 days.

(21) Appl. No.: 11/999,642

(22) Filed: Dec. 5, 2007

(65) Prior Publication Data

US 2009/0145806 A1 Jun. 11, 2009

(51) Int. Cl.
*C10G 45/00* (2006.01)

(52) U.S. Cl. ..... 208/106; 208/107; 205/413; 205/462; 204/165; 204/168; 204/172

(58) Field of Classification Search ..... 208/106–107, 208/142, 208 R, 209, 254 R, 254 H; 422/186.04; 204/165, 168, 172; 205/413, 462
See application file for complete search history.

(56) References Cited

U.S. PATENT DOCUMENTS

| | | | |
|---|---|---|---|
| 3,870,611 | A | 3/1975 | Vestal |
| 3,915,819 | A | 10/1975 | Bell et al. |
| 4,043,884 | A | 8/1977 | Yen et al. |
| 4,120,763 | A | 10/1978 | Breda et al. |
| 4,187,156 | A | 2/1980 | Coleman et al. |
| 4,199,025 | A | 4/1980 | Carpenter |
| 4,204,923 | A | 5/1980 | Carpenter |
| 4,226,683 | A | 10/1980 | Vaseen |
| 4,268,363 | A | 5/1981 | Coughlin |
| 4,279,710 | A | 7/1981 | Coughlin |
| 4,302,320 | A | 11/1981 | Lewis |
| 4,341,608 | A | 7/1982 | St. John |
| 4,389,288 | A | 6/1983 | Vaughan |
| 4,430,175 | A | 2/1984 | Kreysa et al. |
| 4,670,113 | A | 6/1987 | Lewis |
| 5,019,227 | A | 5/1991 | White et al. |
| 5,723,039 | A | 3/1998 | Zosimov et al. |
| 5,843,301 | A | 12/1998 | Esztergar et al. |
| 5,879,529 | A | 3/1999 | Greaney et al. |

(Continued)

FOREIGN PATENT DOCUMENTS

DE 30 29 328 A1 2/1982

OTHER PUBLICATIONS

Sinnott, R.K. (2005). Chemical Engineering Design, 4th ed., Butterworth-Heinemann, 1038 pgs.*

(Continued)

*Primary Examiner* — Walter Griffin
*Assistant Examiner* — Brian McCaig
(74) *Attorney, Agent, or Firm* — Abelman, Frayne & Schwab

(57) ABSTRACT

A method for upgrading a petroleum oil by a hydroprocessing reaction in which the oil is hydrogenated, includes the steps of:

a. forming a liquid reaction mixture of the oil with water and an amphiphilic liquid in predetermined proportions to thereby render the oil and water miscible;
b. introducing the liquid reaction mixture into an electrolytic reactor having one or more cathodic elements formed from a porous high surface area, conductive material;
c. operating the reactor to form reactive hydrogen atoms whereby the oil is hydrogenated by the hydrogen atoms;
d. removing the liquid mixture from the reactor; and
e. separating the hydrogenated upgraded oil from the amphiphilic liquid and any remaining water, e.g., by distillation, recovering and recycling the amphiphilic liquid for use.

48 Claims, 3 Drawing Sheets

U.S. PATENT DOCUMENTS

| | | | |
|---|---|---|---|
| 6,096,191 | A | 8/2000 | Kalnes |
| 6,103,773 | A | 8/2000 | Wittenbrink et al. |
| 6,218,556 | B1 | 4/2001 | Pintauro |
| 6,274,026 | B1 | 8/2001 | Schucker et al. |
| 6,303,019 | B1 | 10/2001 | Siskin et al. |
| 6,387,228 | B1 | 5/2002 | Maget |
| 6,780,304 | B1 | 8/2004 | Maget |
| 6,890,419 | B2 | 5/2005 | Reichman et al. |
| 6,939,458 | B1 | 9/2005 | Nishimura et al. |
| 7,004,985 | B2 | 2/2006 | Wallace et al. |
| 7,005,057 | B1 | 2/2006 | Kalnes |
| 7,005,058 | B1 | 2/2006 | Towler |
| 7,014,750 | B2 | 3/2006 | Boger et al. |
| 7,081,143 | B2 | 7/2006 | Varadaraj et al. |
| 2003/0082415 | A1 | 5/2003 | Joshi et al. |
| 2003/0085156 | A1 | 5/2003 | Schoonover |
| 2004/0101740 | A1 | 5/2004 | Sanders |
| 2004/0202914 | A1 | 10/2004 | Sridhar et al. |
| 2004/0256247 | A1 | 12/2004 | Carson et al. |
| 2004/0259962 | A1 | 12/2004 | Matsui |
| 2006/0013759 | A1 | 1/2006 | Jiang et al. |
| 2006/0018824 | A1 | 1/2006 | Reichman et al. |
| 2006/0019823 | A1 | 1/2006 | Rendina |
| 2006/0049061 | A1 | 3/2006 | Callens et al. |
| 2007/0217995 | A1 | 9/2007 | Matsumura |

OTHER PUBLICATIONS

Santana, D.S. et al. (2004). Journal of Electroanalytical Chemistry, 569, 71-78.*

Santana, D.S. et al. (2003) Tetrahedron Letters, 44, 4725-4727.*

Chambrion, P. et al. (1995) Canadian Journal of Chemistry, 73, 804-815.*

Bhatt et al., "A critical assessment of electrochemistry in a distillable room temperature ionic liquid," The Royal Society of Chemistry 2006, Green Chem, 2006, 8, 161-171.

PCT/US08/13440 International Search Report and Written Opinion, Feb. 10, 2009, 7 pages.

* cited by examiner

UPGRADING CRUDE OIL USING ELECTROCHEMICALLY-GENERATED HYDROGEN

FIELD OF THE INVENTION

This invention relates to a process and apparatus for hydrogenolyzing crude oil in an electrochemical cell or reactor using hydrogen produced in situ by the cell.

BACKGROUND OF THE INVENTION

Crude oil and its derivatives are subjected to a number of processes involving the addition of hydrogen in order to maximize, or upgrade, the distillable fractions to thereby obtain a wide variety of different and more valuable compounds. These processes include hydrocracking, hydrodesulfurization in order to lower the sulfur content of the feedstream and hydrotreating to reduce nitrogen, oxygen and/or metal compounds in the treated stream. In the current practice of these processes, a stream of hydrogen is typically introduced into the treatment vessel where it contacts the feedstream in the presence of one or more catalysts. The hydrogen stream is typically generated in a separate unit or facility, often using natural gas, and then purified, compressed and delivered to the processing vessel. Thus, the cost of hydrocracking, hydrotreating and other such processes must include the capital and operating costs associated with the construction and operation of the unit and/or facilities required to produce the hydrogen stream.

For convenience, the term "hydroprocessing" will be used in this description with the intention that it include any of the other specific methods and processes for treating crude oil and its fractions in which hydrogen is reacted to produce new compounds, typically of lower molecular weight and shorter chain length.

It is well known that hydrogen can be generated electrochemically by dissociation of water molecules to ionic form, i.e., hydrogen atoms, or protons, and oxygen atoms. There is disclosed in U.S. Pat. No. 6,218,556. an electrochemical process for hydrogenating an unsaturated fatty acid, mixtures of two more fatty acids, or the unsaturated fatty acid constituents of an edible or non-edible oil's triglycerides employing a solid polymer electrolyte reactor. In the disclosed process, hydrogen is generated in situ by the electro-reduction of protons that are formed at the anode and then migrate through the ion exchange membrane for reaction. It is stated that only the $H^+$ ions, or protons, carry the electrical current between the anode and cathode thereby circumventing the need for a supporting electrolyte to conduct the electrical current for the process. The method and apparatus of this disclosure is not suitable for use with crude or other heavy mineral oils, since the membrane would be fouled quickly and already has a limited rate of ion transport; also, the membrane apparently has a maximum operating temperature of about 180° C.

A method for generating hydrogen by electrolysis in a subterranean geological formation for the treatment of tar sands is disclosed in U.S. Pat. No. 4,204,923. A typical acid electrolyte is used and the addition of the hydrogen to the petroleum appears to be by absorption. This process does not employ any catalyst or other similar hydroprocessing method.

These disclosures suggest the desirability of a process in which hydrogen is generated via an electrochemical process for use in hydroprocessing of crude oil and its fractions. However, there remains the principal problem of how to bring the hydrogen and the organic molecules of the mineral oil feedstream into contact in order to allow the hydrogenation to take place, e.g., to form an emulsion, that can include foam, while having to then separate the oil and water mixture.

It is therefore an object of the present invention to provide a process and apparatus that will permit the in situ generation of hydrogen atoms by the electrolysis of water molecules which provides for the intimate mixing of the water and hydrocarbon phases during the reaction and then permits the easy separation and recovery of the hydrocarbons from the reaction zone.

Another object of the invention is to provide a method and apparatus for the in situ electrochemical generation of hydrogen atoms, or protons, in the presence of a hydrocarbon feedstream which is subjected to hydroprocessing conditions in order that the hydrogen ions generated can take part in the upgrading reaction on an essentially stoichiometric basis.

It is a further object of the present invention to provide a method in which an ionic material that permits the formation of an intimate mixture of the hydrocarbon feedstream with the electrochemically-generated hydrogen atoms can be easily recovered and recycled for reuse in the process.

SUMMARY OF THE INVENTION

The above objects and other advantages are achieved by the process of the present invention in which an amphiphilic compound possessing both hydrophilic and hydrophobic characteristics is mixed with liquid water and a petroleum feedstream and the mixture is thereafter introduced into an electrochemical reactor having a cathode formed of a porous solid conductive material with a large surface area to retain the hydrogen ions and/or hydrogen atoms and molecules in an adsorbed state until they can complete the reaction with the hydrocarbon; the upgraded petroleum product stream and ionic material are removed from the reactor, subjected to a heating step in which either the ionic material and any remaining water or the upgraded petroleum product stream is vaporized and recovered. In a particularly preferred embodiment, the ionic material is separated during the heating step as a vapor, is condensed and returned for mixing with the heavy oil and water upstream of the reaction vessel. Oxygen recovered from the reactor can be released to the environment or collected for further processing.

In another preferred embodiment, the petroleum product stream has a lower boiling point than the aqueous ionic material and is vaporized and recovered as an upgraded stream. The ionic liquid solution remains a liquid throughout the process and is recycled for mixing with the incoming petroleum feedstream.

The process of the invention provides the advantages of using water as a source of hydrogen, the cost of which is nominal and avoids the expense of consuming natural gas or other conventional materials, and also eliminates the need for a separate hydrogen production unit, such as a steam reformer. Since the hydrogen is generated in situ at the site of the reaction, no facilities or utilities are consumed in hydrogen purification, compression and recirculation. A further advantage is the relatively higher reactivity of hydrogen atoms generated at the electrode as compared to hydrogen molecules which are introduced into the hydroprocessors of the prior art and require one or more catalysts to promote the reaction.

The mixture formed from the feedstream, water and ionic material can include emulsions and microemulsions and the degree of mixing and character of the mixture will vary with the components used. The method of the invention thus broadly comprehends a process in which there will be water molecules in the organic phase.

One advantage of the present invention is the ability to complete the reaction under relatively mild operating conditions of low pressure and temperature. This also results in a reduction in capital costs for the construction of the mixing vessel and the electrochemical reactor as compared to other forms of hydroprocessing vessels and facilities. The operational costs will also be reduced in view of the inexpensive source of hydrogen and the elimination of hydrogen-generating and treating facilities.

BRIEF DESCRIPTION OF THE DRAWINGS

The invention will be described in further detail below and with reference to the attached drawings in which the same numerals are used to identify like elements and in which.

DETAILED DESCRIPTION OF THE PREFERRED EMBODIMENTS

Figure 1:
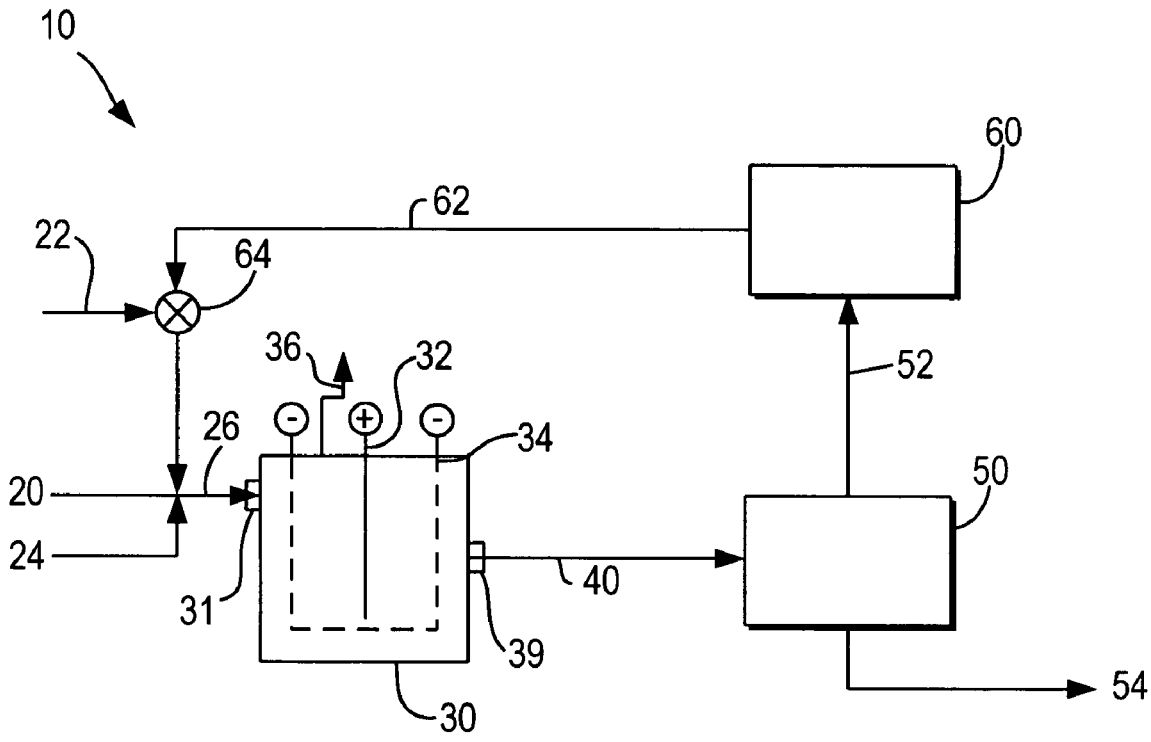
FIG. 1 is a schematic illustration of one embodiment of the method and apparatus of the invention in which the ionic aqueous material is vaporized and separated.

Referring now to the attached drawings, and specifically to FIG. 1, a suitable apparatus is schematically illustrated for practicing one embodiment of the method of the invention. In this embodiment of the complete system 10, a heavy oil petroleum feedstream 20, an ionic amphiphilic liquid 22 and liquid water feed 24 are preferably mixed to form feedstream 26 before entering inlet 31 of the electrochemical reaction vessel 30. Mixing of the feedstreams can be accomplished in any of various types of apparatus that are well known to those of ordinary skill in the art. The most efficient and economical mixing apparatus will be determined based upon the viscocity of the hydrocarbon feedstream as well as the volumetric flow rate to be delivered to the reactor 30.

Reactor 30 includes anode 32 and one or more cathodes 34 to which are applied a source of DC current (not shown). The cathodes are constructed of a porous material, as further described below. The design of the reactor vessel 30 and the electrodes 32, 34 provides for intimate contact between the moving solution containing the oil that is to be hydrogenolyzed and the highly porous surface of the one or more plate or basket cathodes in order to promote the reaction of the hydrogen atoms with the oil molecules. The large surface area of the porous cathode(s) promotes a high reaction rate between hydrogen atoms generated by the dissociation of water molecules and the organic molecules of the petroleum feedstream.

As will be understood by one of ordinary skill in the art, a slight excess of water is present in the solution to exceed the stoichiometric amount required to complete the desired level of reaction. Water can also be injected into the reactor, particularly when the solubility of water in the ionic liquid is limited. The extent of hydrogenolysys can also be controlled by the surface contact time of a given volume of oil as it passes through the reactor. This contact time can further be controlled by various parameters related to the construction of reactor 30, including the flow path, creation of areas of turbulent flow to promote movement of the oil into a contact position with the cathode, the space between the cathode plates, the materials of construction and shape of the cathode plates, operational conditions of temperature, and the like.

With continuing reference to FIG. 1, oxygen atoms generated by the dissociation of water molecules combine to form oxygen molecules which can be withdrawn from cell 30 through outlet 36 for further processing, i.e., accumulation for use in other processes, or simply released into the atmosphere.

The upgraded petroleum product stream 40 containing the ionic liquid material and any remaining water exit through reactor outlet 39 and is introduced into a suitable vessel 50 where they are heated to drive off the ionic liquid and water molecules, e.g., via vapor distillation. In a preferred embodiment of the invention, the ionic material is selected for its capability of being easily separated from the upgraded hydrocarbon stream 40. In this embodiment, a low boiling temperature relative to the petroleum portion is a desirable characteristic of the ionic liquid. In the case of some amphiphillic materials, the liquid decomposes to a gaseous or low boiling compound and then combines on cooling. As used herein, the term "vaporize" will be understood to include this change of chemical state during separation from the upgraded petroleum product.

It is also desirable to control the amount of water entering the system at 24 in order to minimize the amount of water exiting the reaction vessel 30 via stream 40. Small quantities of water in stream 40 can be tolerated; alternatively, water can be removed by other well known drying methods when the volume percent is relatively small, thereby permitting the ionic liquid to be recovered under relatively milder conditions of temperature and pressure.

The upgraded petroleum stream 54 is recovered for use or further processing. The ionic liquid and any water vapor present are condensed in vessel 60, which can take the form of a heat exchanger or other conventional condenser. The ionic liquid recovered as stream 62 is then recycled for use in the process where it can be mixed, as required, with fresh ionic liquid 22, e.g., at a mixing valve 64.

Figure 2:
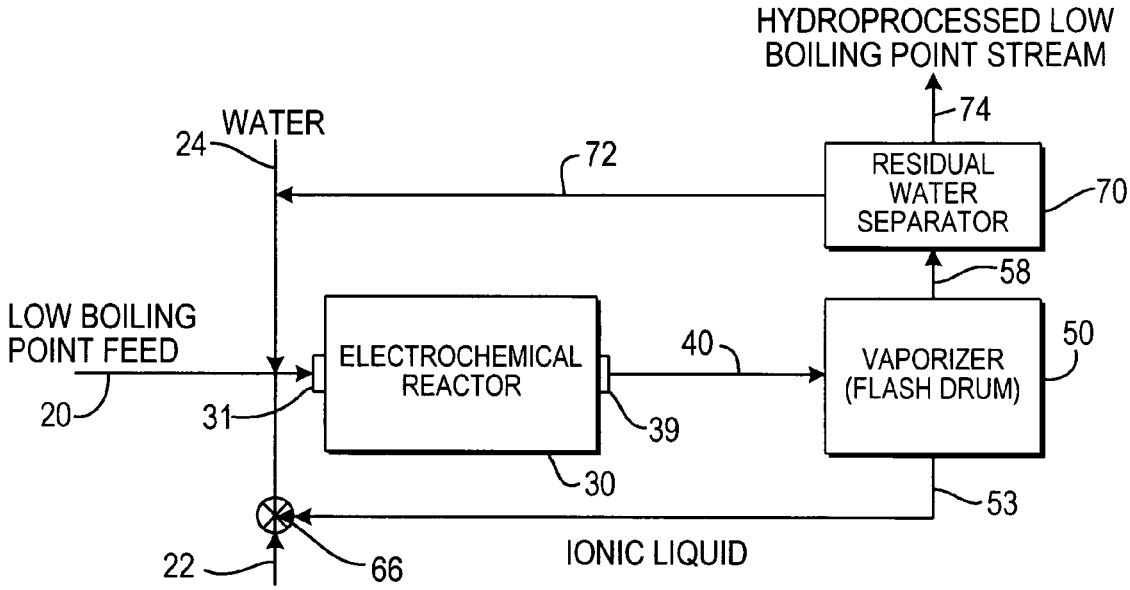
FIG. 2 illustrates another embodiment in which a lower boiling petroleum product is vaporized to separate it from the aqueous ionic material.

Referring now the embodiment schematically illustrated in FIG. 2, a relatively low boiling temperature feedstream 20 is mixed with a predetermined amount of water from feed 24 and a suitable volume of ionic liquid 22. The configuration of the reactor 30 is as described above in connection with FIG. 1.

The upgraded hydrogenolyzed feed and ionic liquid mixture is transferred to a suitable evaporation vessel 50, which can be a flash drum for vaporizing the hydroprocessed petroleum feedstream and any remaining water which leaves as vapor stream 58. Optionally, some or all of the water can remain as a liquid with the recycled ionic liquid, particularly where the boiling point of the hydrocarbon stream is low and it can be removed without vaporizing the water.

Preferably, the water is removed from the hydrocarbon stream in residual water separator 70 which leaves as liquid water stream 72 that can be discarded or optionally returned for reuse and mixed with incoming fresh water stream 24. The hydroprocessed petroleum stream exits the separator at 74 for further processing, either in the form of a vapor or condensed liquid stream.

The ionic liquid stream 53 recovered from the bottom of the flash drum vaporizer is returned for reuse in the process via mixing valve 66 for blending with fresh ionic liquid stream 22.

Figure 3:
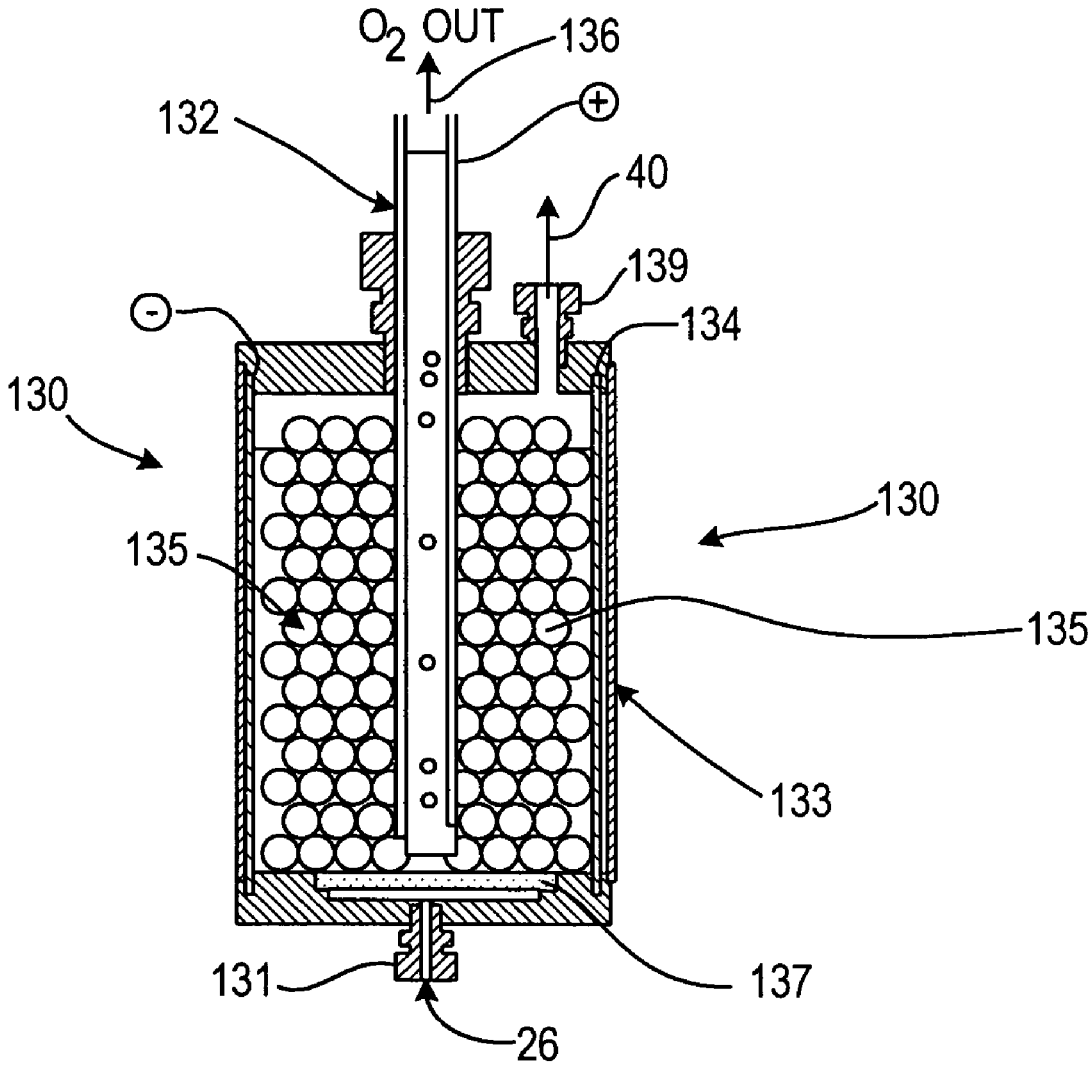
FIG. 3 is a schematic side elevational view of one embodiment of a reactor that is suitable for use in the practice of the method of the invention.

Referring now to FIG. 3, an embodiment is shown for the practice of the invention in a conductive packed bed reactor 130. The reactor includes an insulated housing 133, a centrally positioned anode 132 and one or more cathodes 134. In the particular embodiment illustrated in FIG. 3, central anode 132 is of hollow tubular construction and the surrounding cathode 134 is generally cylindrical and maintained in position inside of the insulated housing 133. The annular space between the two electrodes is filled with a stationary packed bed of electrically conductive material 135 that is porous and which is capable of entraining hydrogen ions, i.e., protons, or hydrogen atoms, or molecules so that they can react with the petroleum feedstream to provide an enhanced hydro-processed product stream.

With continuing reference to FIG. 3, a mixed feedstream 26 consisting of the petroleum product that is to be hydrogenolyzed, water and the ionic amphiphilic material enters through inlet 131 and diffuser 137 from which it passes through the fixed conducting bed of porous material 135. The treated product stream 40 exits through reactor outlet 139. Oxygen accumulating from the dissociation of the water molecules exits as stream 136 through the annulus of central electrode 132. Thereafter the mixed product stream 40 can be subjected to the further processing as described above in connection with FIG. 1.

Suitable ionic compounds for use in the method of the invention include carbamate and ammonium compounds. These compounds are produced by reacting $CO_2$ with primary or secondary amines. The general structure of useful carbamates and quaternary ammonium compounds are set forth below.

(1)

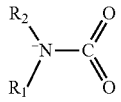

carbamate (2)

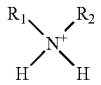

quaternary ammonium where $R_1$ and $R_2$ are alkyl groups or hydrogen.

Useful ionic compounds include diethylcarbamate (anion) and diethylammonium (cation). Due to reaction variables, diethylamine (neutral) can also be present.

(3)

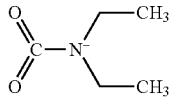

diethylcarbamate (4)

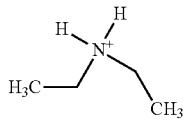

diethylammonium (5)

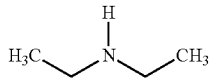

diethylamine

In the second embodiment of the process where the hydrocarbon stream is more volatile than the ionic liquid product to be hydrogenolyzed, e.g., naphtha, a different class of ionic liquids is utilized. Useful cations include: 1-alkyl-3-methylimidazolium, N-alkyl-pyridinium, tetraalkyl-ammonium, and tetraalkyl-phosphonium.

The following water-insoluble anions can be utilized in this embodiment:

$$[PF_6]^-,\ [(CF_3SO_2)_2N]^- \text{ and } [BR_1R_2R_3R_4]^-.$$

Partially water-soluble anions include $[BF_4]^-$ and $[CF_3SO_3]^-$. Substantially water-soluble anions include $[CH_3CO_2]^-$, $[CF_3CO_2]^-$, $[NO_3]^-$, $Br^-$, $Cl^-$, $I^-$, $[Al_2Cl_7]^-$, and $[AlCl_4]^-$. It is noted that the latter two aluminum ions will decompose over time in the presence of water and oxygen.

In a further embodiment of the invention, the amphiphilic material is separated from the upgraded petroleum product stream by a reaction which changes the molecular configuration to one which has only a hydrophilic characteristic. In this embodiment, the two layers are allowed to separate upon standing to form a clear interface after which the petroleum layer is easily withdrawn. In another embodiment, the ionic liquid is chosen for its ability to change characteristics in response to changes in temperature. Specifically, the ionic liquid will phase separate from the mixture upon a reduction in temperature.

In order to further illustrate the practice of the invention, the following laboratory-scale examples are provided. These examples describe the preparation of an amphiphilic ionic liquid, the preparation of a reaction mixture, and finally the determination of its conductivity.

Step I—Preparation of an Ionic Liquid

A 250 ml 2-necked round bottom flask was placed in a water bath maintained at 40° C. and 100 grams of diethylamine was added. The flask was fitted with a gas purge tube connected to a $CO_2$ cylinder and an ethylene glycol condenser and $CO_2$ was bubbled slowly into the diethyl amine for six hours. A clear yellowish liquid reaction product was obtained in accordance with the following reaction scheme:

$$2(CH_3CH_2)_2NH2+CO2 \rightarrow (CH_3CH_2)_2NH_2^+ + (CH_3CH_2)_2NCO_2^- \quad (6)$$

Step II—Preparation of Mixture of Ionic Liquid-Water-Hydrocarbon

To 4 grams of the liquid prepared in Step I was added one gram of water and 0.500 gram of benzene. The mixture was shaken vigorously to yield a single phase homogenous mixture that did not separate upon standing at room temperature.

Step III—Conductivity Test

The mixture prepared in Step II was placed in a 10 ml vial fitted with one platinum wire electrode and a stainless steel wire electrode to provide an electrolytic cell. The electrodes were connected to a potentiostat set at 2 volts. The current measured at room temperature was 0.078 mA. Due to the nature of the electrodes, no hydrogenation could be expected.

The following amphiphilic compounds have been identified as suitable for use in the practice of the invention:

1-benzyl-3-methyl-imidazolium chloride, $(CH_3CH_2)_2NH_2^+$ and $(CH_3CH_2)_2NCO_2^-$.

Surfactants comprise another class of amphiphilic compounds. The following compounds have been identified for use in the method of the invention:

1. Alkyltrimethyl quaternary ammonium salts of the general formula $RN^+(CH_3)_3Cl^-$, where R is alkyl.
2. Dialkyldimethyl quaternary ammonium salts of the general formula $R_2N^+(CH_3)_2(X)^-$, where R is alkyl and X=Cl, $NO_2$ and $OSO_2OCH_3$.

3. Benzylalkyl quaternary ammonium salts of the general formula $R_2N^+CH_3CH_2C_6H_5Cl^-$ and $RN^+(CH_3)_2CH_2C_6H_5Cl^-$ where R is alkyl.
4. Ethoxylated quaternary ammonium salts including ethoxylated monoalkyl quaternary acetates.
5. Alkyl diammonium pentamethyl chlorides of the general formula $$RN^+(CH_3)_2(CH_2)_3N^+(CH_3)_3Cl_2^- \text{ where R is alkyl.}$$

6. Sulfates, sufonates and phosphates including alkyl sulfates, alkyl ether sulfates, alkyl aryl ether sulfates, alkyl naphthalene sulfonates and sulfosuccinates.

As will be apparent from the above description, various modifications to the method and apparatus can be made by one of ordinary skill in the art without departing from the true scope of the invention which is to be determined with reference to the claims that follow.

I claim:

1. A method for hydrogenolyzing one or more non-polar organic compounds that are immiscible or only slightly miscible with water, the process comprising:

a. providing in an electrolytic reactor an intimate mixture of water, the one or more organic compounds and an amphiphilic material in the form of a liquid or finely divided solid;

b. operating the reactor to dissociate the water molecules in the mixture to form hydrogen and oxygen atoms, whereby the organic compound reacts at the cathode with the hydrogen atoms and is hydrogenolyzed; and c. recovering the hydrogenolyzed organic compound from the reactor.

2. The method of claim 1 in which the recovery of the hydrogenolyzed organic compound includes the step of heating the mixture from the reactor to vaporize the amphiphilic liquid and any remaining water, and separating the vapors from the organic compound.

3. The method of claim 1 in which the recovery of the hydrogenolyzed organic compound includes the step of heating the mixture to vaporize the organic compound.

4. The method of claim 3 in which the amphiphilic liquid is recycled with a portion of the water introduced into the reactor in step (a).

5. The method of claim 4 in which the volume of the recycled water is determined with respect to fresh water added to form the mixture in step (a).

6. The method of claim 1 in which the mixture includes a volume of water that is proportional to the number of hydrogen atoms that are to be reacted to hydrogenolyze the organic compound.

7. The method of claim 1 in which the electrolytic reactor is provided with at least one cathodic plate having at least one porous surface with a high surface area, whereby the hydrogen atoms in the mixture are spatially separated from each other following their disassociation.

8. The method of claim 7 in which the electrolytic reactor is provided with a plurality of cathodic plates.

9. The method of claim 1 in which the mixture is subjected to turbulent flow as it passes through the electrolytic reactor.

10. The method of claim 1 in which the amphiphilic solid material is separated from the recovered hydrogenolyzed organic compound by filtration or by liquid-liquid extraction.

11. The method of claim 1 in which a voltage differential of from 0.01 to 200 volts is applied to the anode and cathode plates of the electrolytic reactor.

12. The method of claim 1 where the water is injected into the electrolytic reactor under pressure in order to form the intimate mixture with the other compounds.

13. The method of claim 1 where the intimate mixture is formed prior to its introduction into the electrolytic reactor.

14. The method of claim 1 wherein the amphiphilic material includes a cation selected from the group consisting of quaternary ammonium, diethylammonium, 1-alkyl-3-methylimidazolium, N-alkyl-pyridinium, tetraalkyl-ammonium, and tetraalkyl-phosphonium.

15. The method of claim 1 wherein the amphiphilic material includes an anion selected from the group consisting of carbamate, deithylcarbamate, $[PF_6]^-$, $[(CF_3SO_2)_2N]^-$, $[BR_1R_2R_3R_4]^-$, $[BF_4]^-$, $[CF_3SO_3]^-$,$[CH_3CO_2]^-$, $[CF_3CO_2]^-$, $[NO_3]^-$, $Br^-$, $Cl^-$, $I^-$, $[Al_2Cl_7]^-$, and $[AlCl_4]^-$.

16. The method of claim 1 wherein the amphiphilic material is selected from the group consisting of 1-benzyl-3-methyl-imidazolium chloride, $(CH_3CH_2)_2NH_2^+$ and $(CH_3CH_2)_2NCO_2^-$.

17. The method of claim 1 wherein the amphiphilic material is selected from the group consisting of alkyltrimethyl quaternary ammonium salts of the general formula $RN^+(CH_3)_3\ Cl^-$, where R is alkyl.

18. The method of claim 1 wherein the amphiphilic material is selected from the group consisting of dialkyldimethyl quaternary ammonium salts of the general formula $$RN^+(CH_3)_2\ (X)^-,$$

where R is an alkyl and X is Cl, $NO_2$ or $OSO_2OCH_3$.

19. The method of claim 1 wherein the amphiphilic material is selected from the group consisting of benzylalkyl quaternary ammonium salts of the general formula $$RN^+CH_3CH_2C_6H_5Cl^- \text{ and } RN^+(CH_3)_2CH_2C_6H_5Cl^-$$

where R is an alkyl.

20. The method of claim 1 wherein the amphiphilic material is selected from the group consisting of ethoxylated quaternary ammonium salts including ethoxylated monoalkyl quaternary acetates.

21. The method of claim 1 wherein the amphiphilic material is selected from the group consisting of alkyl diammonium pentamethyl chlorides of the general formula $$RN^+(CH_3)_2(CH_2)_3N^+(CH_3)_3Cl_2^-$$

where R is an alkyl.

22. The method of claim 1 wherein the amphiphilic material is selected from the group consisting of sulfates, sufonates and phosphates including alkyl sulfates, alkyl ether sulfates, alkyl aryl ether sulfates, alkyl naphthalene sulfonates and sulfosuccinates.

23. The method of claim 1, wherein the intimate mixture of water, the one or more organic compounds and an amphiphilic material in the form of a liquid or finely divided solid are introduced into an inlet of a conductive packed bed reactor, the conductive packed bed reactor including an insulated housing;

an anode having hollow tubular construction centrally positioned inside the insulated housing;

one or more cathodes surrounding the anode and cylindrically maintained inside the insulated housing;

an electrically conductive material to fill the annular space between the anode and the cathodes;

an inlet having an associated diffuser that is in fluid communication with the electrically conductive material;

a treated product outlet that is in fluid communication with the electrically conductive material; and an oxygen outlet that is in fluid communication with an annulus of the hollow tubular anode.

24. The method of claim 23, further comprising operating the conductive packed bed reactor to dissociate the water molecules in the mixture to form hydrogen and oxygen atoms, whereby the organic compound reacts at the cathode with the hydrogen atoms and is hydrogenolyzed;

recovering oxygen from the oxygen outlet; and recovering the hydrogenolyzed organic compound from the treated product outlet.

25. A method for hydrotreating or hydrocracking one or more non-polar organic compounds that are immiscible or only slightly miscible with water, the process comprising:

a. providing in an electrolytic reactor an intimate mixture of water, the one or more organic compounds and an amphiphilic material in the form of a liquid or finely divided solid;

b. operating the reactor to dissociate the water molecules in the mixture to form hydrogen and oxygen atoms, whereby the organic compound reacts at the cathode with the hydrogen atoms and is hydrotreated or hydrocracked; and c. recovering the hydrotreated or hydrocracked organic compound from the reactor.

26. The method of claim 25 in which the recovery of the hydrotreated or hydrocracked organic compound includes the step of heating the mixture from the reactor to vaporize the amphiphilic liquid and any remaining water, and separating the vapors from the organic compound.

27. The method of claim 25 in which the recovery of the hydrotreated or hydrocracked organic compound includes the step of heating the mixture to vaporize the organic compound.

28. The method of claim 27 in which the amphiphilic liquid is recycled with a portion of the water introduced into the reactor in step (a).

29. The method of claim 28 in which the volume of the recycled water is determined with respect to fresh water added to form the mixture in step (a).

30. The method of claim 25 in which the mixture includes a volume of water that is proportional to the number of hydrogen atoms that are to be reacted to hydrotreat or hydrocrack the organic compound.

31. The method of claim 25 in which the electrolytic reactor is provided with at least one cathodic plate having at least one porous surface with a high surface area, whereby the hydrogen atoms in the mixture are spatially separated from each other following their disassociation.

32. The method of claim 31 in which the electrolytic reactor is provided with a plurality of cathodic plates.

33. The method of claim 25 in which the mixture is subjected to turbulent flow as it passes through the electrolytic reactor.

34. The method of claim 25 in which the amphiphilic solid material is separated from the recovered hydrotreated or hydrocracked organic compound by filtration or by liquid-liquid extraction.

35. The method of claim 25 in which a voltage differential of from 0.01 to 200 volts is applied to anode and cathode plates of the electrolytic reactor.

36. The method of claim 25 where the water is injected into the electrolytic reactor under pressure in order to form the intimate mixture with the other compounds.

37. The method of claim 25 where the intimate mixture is formed prior to its introduction into the electrolytic reactor.

38. The method of claim 25 wherein the amphiphilic material includes a cation selected from the group consisting of quaternary ammonium, diethylammonium, 1-alkyl-3-methylimidazolium, N-alkyl-pyridinium, tetraalkyl-ammonium, and tetraalkyl-phosphonium.

39. The method of claim 25 wherein the amphiphilic material includes an anion selected from the group consisting of carbamate, deithylcarbamate, $[PF_6]^-$, $[(CF_3SO_2)_2N]^-$, $[BR_1R_2R_3R_4]^-$, $[BF_4]^-$, $[CF_3SO_3]^-$, $[CH_3CO_2]^-$, $[CF_3CO_2]^-$, $[NO_3]^-$, $Br^-$, $Cl^-$, $I^-$, $[Al_2Cl_7]^-$, and $[AlCl_4]^-$.

40. The method of claim 25 wherein the amphiphilic material is selected from the group consisting of 1-benzyl-3-methyl-imidazolium chloride, $(CH_3CH_2)_2NH_2^+$ and $(CH_3CH_2)_2NCO_2^-$.

41. The method of claim 25 wherein the amphiphilic material is selected from the group consisting of alkyltrimethyl quaternary ammonium salts of the general formula $RN^+(CH_3)_3\ Cl^-$, where R is alkyl.

42. The method of claim 25 wherein the amphiphilic material is selected from the group consisting of dialkyldimethyl quaternary ammonium salts of the general formula $$RN^+(CH_3)_2\ (X)^-,$$

where R is an alkyl and X is Cl, $NO_2$ or $OSO_2OCH_3$.

43. The method of claim 25 wherein the amphiphilic material is selected from the group consisting of benzylalkyl quaternary ammonium salts of the general formula $$RN^+CH_3CH_2C_6H_5Cl^- \text{ and } RN^+(CH_3)_2CH_2C_6H_5Cl^-$$

where R is an alkyl.

44. The method of claim 25 wherein the amphiphilic material is selected from the group consisting of ethoxylated quaternary ammonium salts including ethoxylated monoalkyl quaternary acetates.

45. The method of claim 25 wherein the amphiphilic material is selected from the group consisting of alkyl diammonium pentamethyl chlorides of the general formula $$RN^+(CH_3)_2(CH_2)_3N^+(CH_3)_3Cl_2-$$

where R is an alkyl.

46. The method of claim 25 wherein the amphiphilic material is selected from the group consisting of sulfates, sufonates and phosphates including alkyl sulfates, alkyl ether sulfates, alkyl aryl ether sulfates, alkyl naphthalene sulfonates and sulfosuccinates.

47. The method of claim 25, wherein the intimate mixture of water, the one or more organic compounds and an amphiphilic material in the form of a liquid or finely divided solid are introduced into an inlet of a conductive packed bed reactor, the conductive packed bed reactor including an insulated housing;

an anode having hollow tubular construction centrally positioned inside the insulated housing;

one or more cathodes surrounding the anode and cylindrically maintained inside the insulated housing;

an electrically conductive material to fill the annular space between the anode and the cathodes;

an inlet having an associated diffuser that is in fluid communication with the electrically conductive material;

a treated product outlet that is in fluid communication with the electrically conductive material; and an oxygen outlet that is in fluid communication with an annulus of the hollow tubular anode.

48. The method of claim 47, further comprising operating the conductive packed bed reactor to dissociate the water molecules in the mixture to form hydrogen and oxygen atoms, whereby the organic compound reacts at the cathode with the hydrogen atoms and is hydrogenolyzed;

recovering oxygen from the oxygen outlet; and recovering the hydrotreated or hydrocracked organic compound from the treated product outlet.

* * * * *